US006293004B1

(12) United States Patent
Holliday

(10) Patent No.: US 6,293,004 B1
(45) Date of Patent: Sep. 25, 2001

(54) LENGTHWISE COMPLIANT CRIMPING TOOL

(76) Inventor: Randall A. Holliday, 11047 Tennyson Pl., Westminster, CO (US) 80030

( * ) Notice: Subject to any disclaimer, the term of this patent is extended or adjusted under 35 U.S.C. 154(b) by 0 days.

(21) Appl. No.: 09/356,859

(22) Filed: Jul. 19, 1999

Related U.S. Application Data

(63) Continuation-in-part of application No. 09/150,154, filed on Sep. 9, 1998, now Pat. No. 6,089,913.

(51) Int. Cl.[7] ..... H01R 43/042
(52) U.S. Cl. ..... 29/751; 29/753; 29/758
(58) Field of Search ..... 29/751, 750, 753, 29/758, 869, 764, 748, 33 M; 81/439, 440, 313, 355; 439/133, 135, 136

(56) References Cited

U.S. PATENT DOCUMENTS 2,369,180 * 2/1945 Rosenthal ..... 29/751
4,307,504 * 12/1981 Davis et al. ..... 29/566.3
4,532,691 * 8/1985 Brandeau ..... 29/566.4
4,534,107 * 8/1985 Maack ..... 29/751
5,469,613 * 11/1995 McMills et al. ..... 29/751
5,647,119 * 7/1997 Bourbeau et al. ..... 29/751
5,842,268 * 12/1998 Arnfield ..... 29/566.4
5,934,137 * 8/1999 Tarpill ..... 72/409.14
5,983,489 * 11/1999 Jee ..... 29/751
6,026,671 * 2/2000 Battenfield ..... 72/409
6,065,326 * 5/2000 Frenken ..... 72/453.15

* cited by examiner

*Primary Examiner*—Lee Young
*Assistant Examiner*—Minh Trinh
(74) *Attorney, Agent, or Firm*—John E. Reilly

(57) ABSTRACT

A hand-held crimping tool is characterized by having an elongated body and a lever arm which is pivoted at one end to the body to actuate a plunger having a chuck and spring-loaded biasing member movable toward and away from a seat on a die portion into which a coaxial cable end can be inserted in facing relation to the biasing member, a plurality of crimpable connectors in succession being loosely assembled on each cable end between the biasing member and seat so that when the lever arm or handle is squeezed toward the body and imparts axial movement to the plunger to force a preassembled crimping ring on each connector to radially compress each connector into sealed engagement with the cable end, the biasing member will compensate for differences in length of said connctors.

23 Claims, 7 Drawing Sheets

LENGTHWISE COMPLIANT CRIMPING TOOL

CROSS-REFERENCE TO RELATED APPLICATION

This application is a continuation-in-part of U.S. patent application Ser. No. 09/150,154, filed Sep. 9, 1998, now U.S. Pat. No. 6,089,913 issued Jul. 18, 2000 for END CONNECTOR AND CRIMPING TOOL FOR COAXIAL CABLE, by Randall A. Holliday.

BACKGROUND AND FIELD OF INVENTION

This invention relates to crimping tools, and more particularly relates to a novel and improved hand-held crimping tool for compressing fittings of different lengths into sealed engagement with cables of the type used in the cable TV industry.

Various types of hand-held crimping tools have been developed for attaching an end fitting or connector to the end of a coaxial cable in order to facilitate its connection into the terminal of a television set. I have previously devised jointly with others crimping tools of the type which are characterized by effecting the desired reduction in diameter or size of the cable end of the fitting into a generally circular configuration by applying an axially directed force to the fitting, as opposed to direct radial compression. Two patents of direct interest include U.S. Pat. No. 5,392,508 for AXIAL DEFORMATION CRIMPING TOOL and U.S. Pat. No. 5,743,131 for RATCHETED CRIMPING TOOL. More recently, I devised a pre-installed crimping ring as a means of applying axial force to the fitting with the aid of a crimping tool as set forth and described in detail in U.S. patent application Ser. No. 150,154 for END CONNECTOR AND CRIMPING TOOL FOR COAXIAL CABLE assigned to the assignee of this application and incorporated by reference herein.

Although the type of crimping tools described has been extremely effective in practice, there is a continuing need for a universal type of crimping tool which is self-compensating for slight differences in length of the various coaxial cable fittings presently on the market as well as differences in length resulting from manufacturing tolerances, dirt or wear. In achieving a secure, sealed connection between the fitting and cable end, the cable end is first drawn fully into the end of the connector and loosely assembled in the crimping tool as a preliminary to the crimping operation. The pre-installed crimping ring is characterized by being responsive to an axial or lengthwise applied force to impart radial compression to the connector in crimping it firmly against the cable end. It is therefore desirable that the tool be capable of absorbing or compensating for any force applied once the optimum degree of crimping is reached at the end of the crimping stroke. In this regard, it is also desirable that the manual force or pressure applied to the crimping tool during each crimping cycle will be translated into a progressively increased force toward the end of the cycle so as to overcome any increased resistance to crimping.

SUMMARY OF THE INVENTION

Accordingly, an object of the present invention is to provide for a novel and improved crimping tool adaptable for use in compressing a fitting onto the end of a cable in a highly efficient and dependable manner.

Another object of the present invention is to provide for a novel and improved hand-held crimping tool for rapidly and efficiently crimping a fitting into uniform sealed engagement with a coaxial cable and wherein the crimping tool is self-adjusting, or lengthwise compliant, to achieve a uniform seal notwithstanding differences in length of the fitting or to compensate for the presence of wear or dirt and manufacturing tolerances.

A further object of the present invention is to provide for a novel and improved hand-held crimping tool of simplified manufacture which is lightweight, portable and compact as well as being easy to grip.

It is a still further object of the present invention to provide for a novel and improved hand-held, portable crimping tool for use in rapidly and efficiently crimping a fitting onto the end of a coaxial cable which possesses an optimum mechanical advantage in effecting uniform sealed engagement between the fitting and cable toward the end of each crimping stroke.

An additional object of the present invention is to provide for a novel and improved crimping tool which is extremely compact and employs a lever arm which is folded into overlying relation to the main body of the crimping tool as it applies a crimping force to each fitting.

In accordance with the present invention, an improved biasing member has been devised for a hand-held crimping tool of the type which is adapted to connect a sleeve portion of a cable fitting to an end of a coaxial cable wherein the tool is provided with a body having an end stop at one end of a cable-receiving channel, a chuck axially spaced from the end stop for supporting the sleeve in facing relation to the end stop with the cable end extending through the channel and at least partially inserted into the sleeve, and support means mounting the chuck for axial advancement toward and away from the end stop whereby to force a crimping ring on the sleeve axially under sufficient force to radially contract the sleeve into crimping engagement with the cable end, the improved biasing member absorbing any continued axial movement of the chuck after the crimping ring contracts the sleeve to its maximum limit onto the cable end, and force-applying means for axially advancing the chuck toward and away from the end stop. Preferably, the biasing means is defined by a spring member or other reslient member mounted under axial compression between the chuck and end of the force-applying means or on the end stop. In turn, the force-applying means takes the form of a lever arm or handle pivoted at one end to a plunger which carries the chuck at one end thereof and wherein the lever arm is movable into overlying relation to the body as a progressively increasing crimping force is applied to the chuck.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
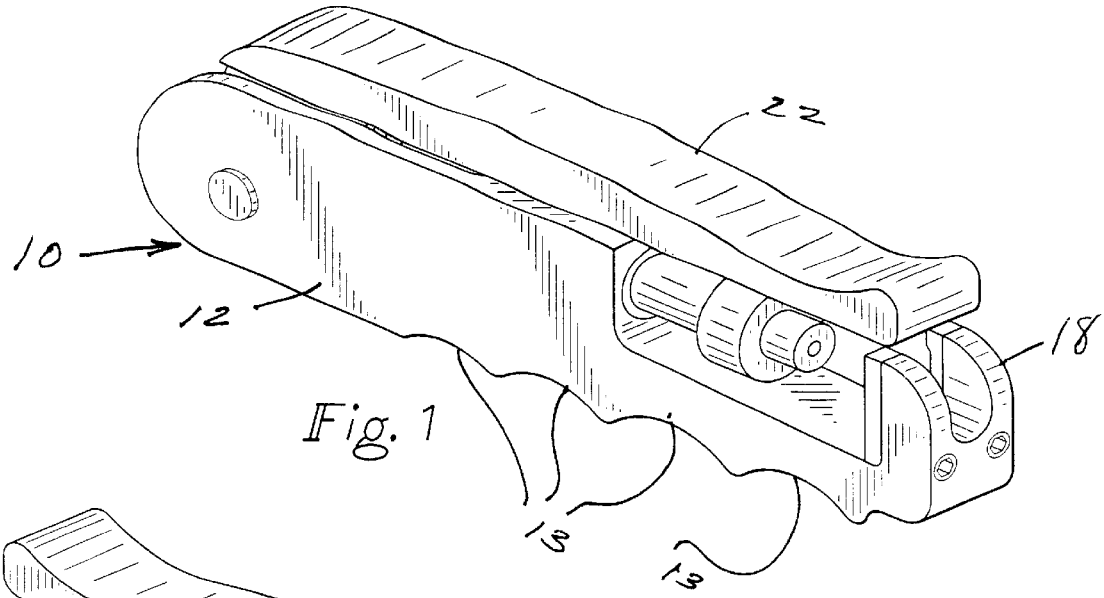
FIG. 1 is a perspective view illustrating a preferred form of crimping tool.
Figure 2:
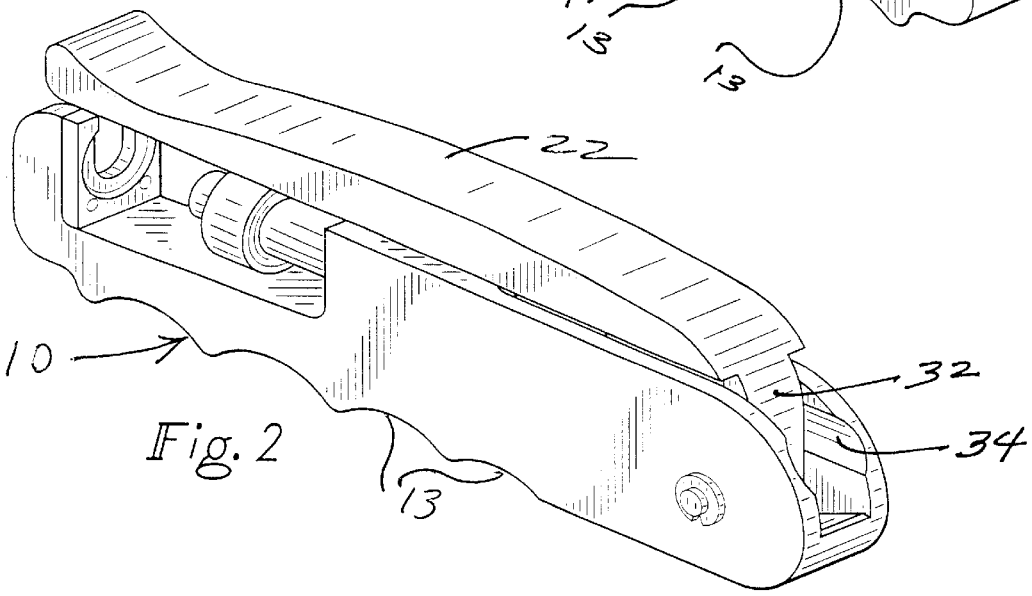
FIG. 2 is another perspective view from the rear of the preferred form of crimping tool shown in FIG. 1.
Figure 3:
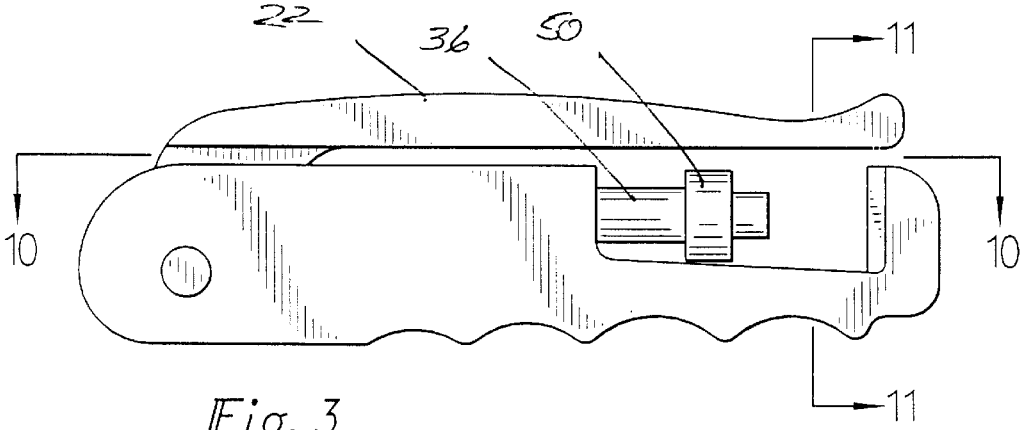
FIG. 3 is a side view in elevation of the preferred crimping tool illustrated in FIGS. 1 and 2.
Figure 4:
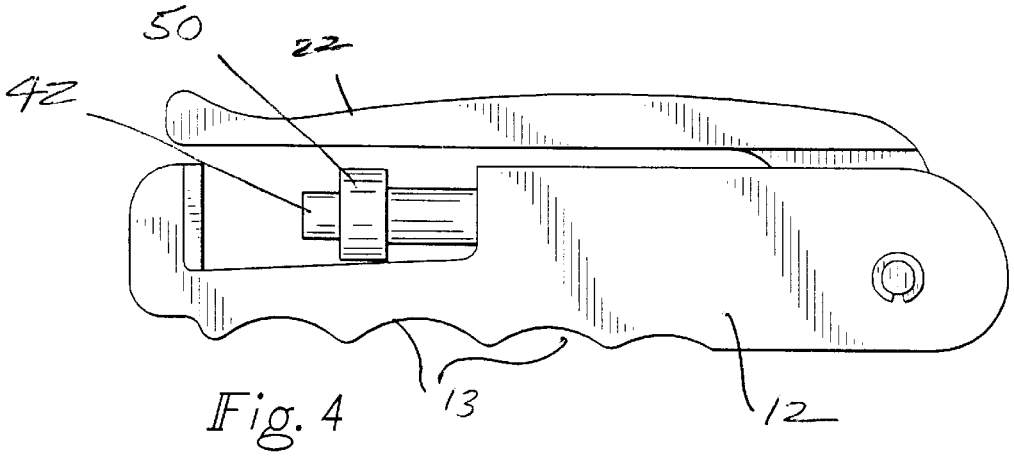
FIG. 4 is an opposite side view to that shown in FIG. 3.
Figure 5:
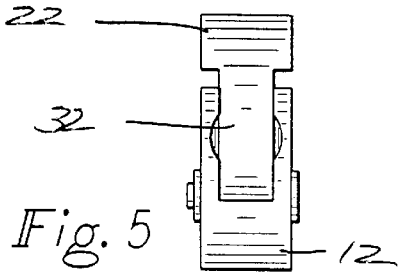
FIG. 5 is an end view from the pivotal end of the crimping tool as shown in FIGS. 1 to 4.
Figure 6:
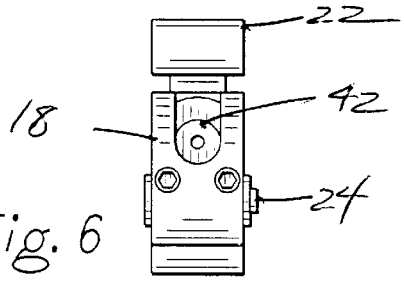
FIG. 6 is an opposite end view of that shown in FIG. 5.
Figure 7:
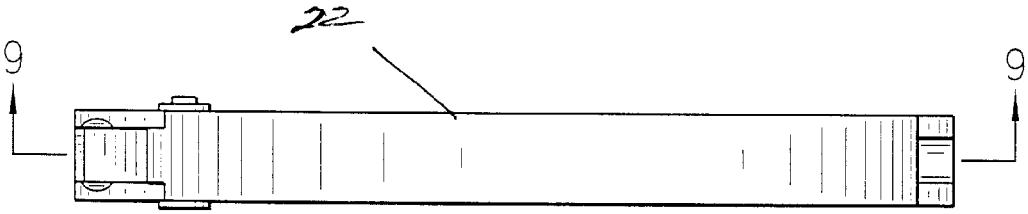
FIG. 7 is a top plan view of the preferred crimping tool.
Figure 8:
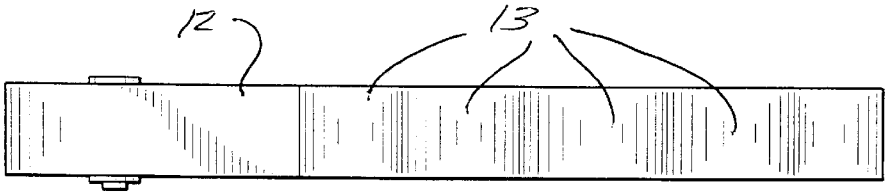
FIG. 8 is a bottom plan view of the preferred crimping tool.
Figure 9:
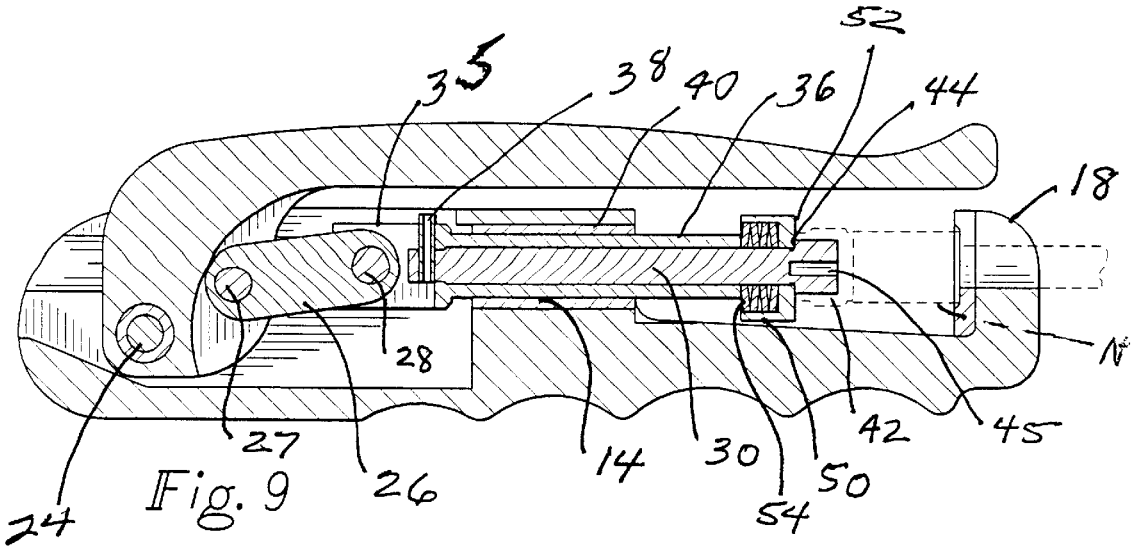
FIG. 9 is a longitudinal sectional view of the preferred crimping tool shown at the completion of a crimping operation.
Figure 10:
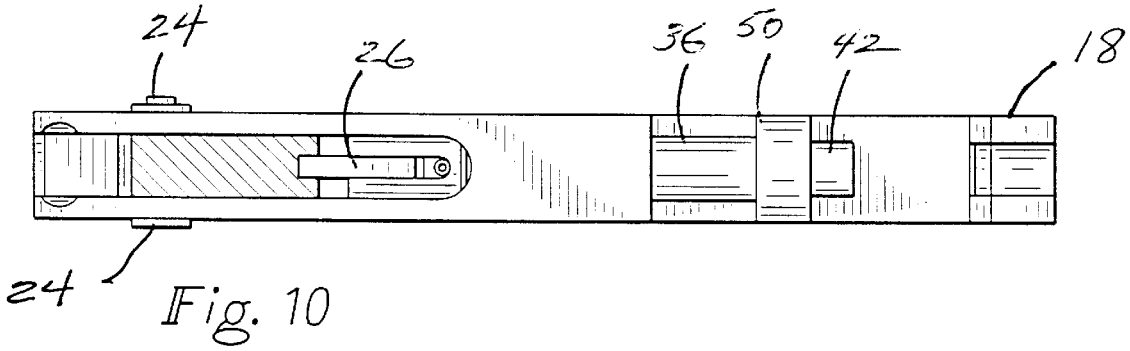
FIG. 10 is a sectional view taken about lines 10—10 of FIG. 3.
Figure 11:
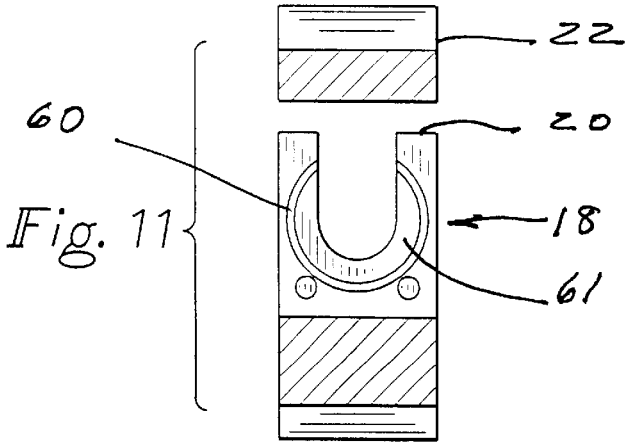
FIG. 11 is a cross-sectional view taken about lines 11—11 of FIG. 3.

Referring in detail to the drawings, there is shown in FIGS. 1 to 16 a preferred form of hand-held crimping tool 10 which is broadly comprised of an elongated body 12 having a plunger-receiving bore 14 extending through an intermediate portion of the body 12. A die portion 18 is disposed at one end of the recess opposite to the plunger-receiving opening and is provided with a generally U-shaped recess or saddle portion 20 for a purpose to be described. A lever arm 22 is pivoted by a pivot shaft 24 at one end of the body 12 opposite to the die member and, as best seen from FIG. 9, is provided with a floating link 26 pivotally attached as at 27 in offset relation to the lever arm 22 and pivotally attached at 28 to one end of a plunger 30 extending through the bore 14 in the body. Further, the lever arm 22 is of flat elongated configuration and of a width substantially corresponding to the width of the body 12 but having a pivotal end 32 of reduced width for insertion through a recessed portion 34 at the pivotal end of the body so as to permit free pivotal movement of the arm or handle 22 between an open position as illustrated in FIG. 13 and a closed position as illustrated in FIGS. 1 to 3. Preferably, the pivotal end 32 of the arm 22 is bifurcated, as best seen from FIG. 16, for insertion of one end of the link 26 and retained by a pivot pin 27. The opposite end of the link 26 is inserted in a bifurcated end 35 of sleeve 36 and retained by a pivot pin 28; and the bifurcated end 35 is slotted as at 35' for insertion of a pin 38, the pin 38 acting as a limit stop for the sleeve 36.

A bushing 40 is mounted in the bore 14 to slidingly receive the plunger assembly made up of the plunger 30 and sleeve 36 for lengthwise advancement of the plunger assembly through the body under the control of the lever arm 22. The plunger 30 terminates in an enlarged end 42 of generally cylindrical configuration having an external shoulder 44 and a counterbore 45, the latter disposed in facing relation to the die portion 18. The chuck 42 is dimensioned for insertion into the open end of a conventional fitting F as a preliminary to the crimping operation to be described.

An important feature of the present invention resides in a biasing member in the form of a generally cup-shaped housing 50 slidably disposed on the plunger body 30 and having its annular end wall 52 biased against the shoulder 44 by a spring member 54 interposed between the end wall 52 and the end of the sleeve 36. The spring 54 preferably is in the form of a series of stacked annular disks or washers 55 canted in opposite directions and mounted under compression between the sleeve 36 and end wall 52, the pin acting as a limit stop as described while permitting the sleeve 36 to advance away from the pin 38 when the lever arm approaches its end of travel as hereinafter discussed in greater detail. One commercially available form of spring member 55 is referred to as Disk Springs or Belleville washers manufactured and sold by Century Spring Corporation of Los Angeles, Calif. As shown in FIG. 9, the disks 55 are arranged in what is referred to as a "series stack". However, they may be arranged in a "parallel stack" or nested relation to one another, or in a parallel-series stack. The particular arrangement depends upon the amount of deflection desired for a given load.

A modified form of spring to the spring member 54 is illustrated in FIG. 13 and takes the form of a coil spring 56 mounted under compression within the housing 50 so as to yieldingly urge the annular end wall 52 against the shoulder 44.

Figure 14:
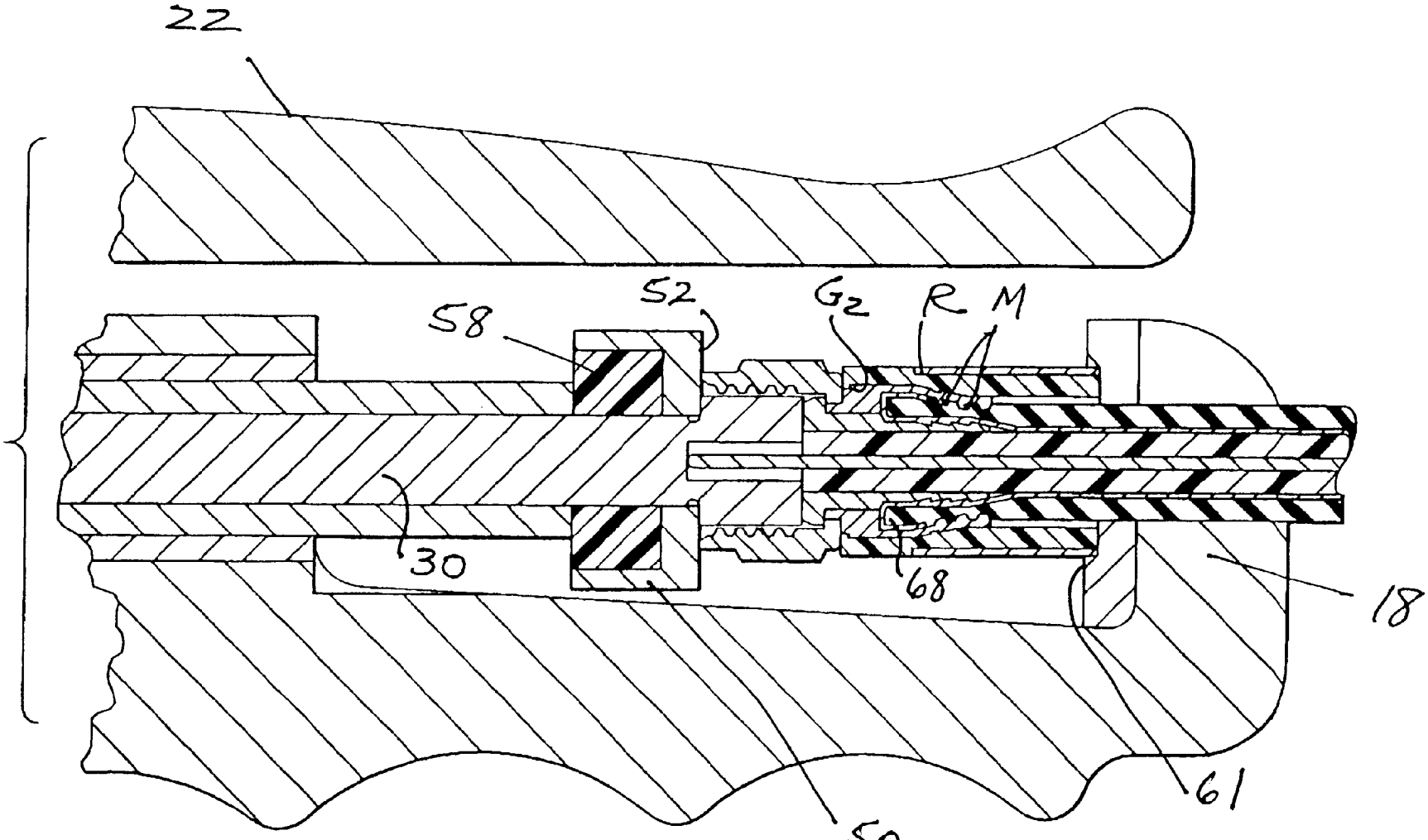
FIG. 14 is another somewhat fragmentary enlarged sectional view similar to FIG. 12 but illustrating the parts at the completion of a crimping stroke.
Figure 15:
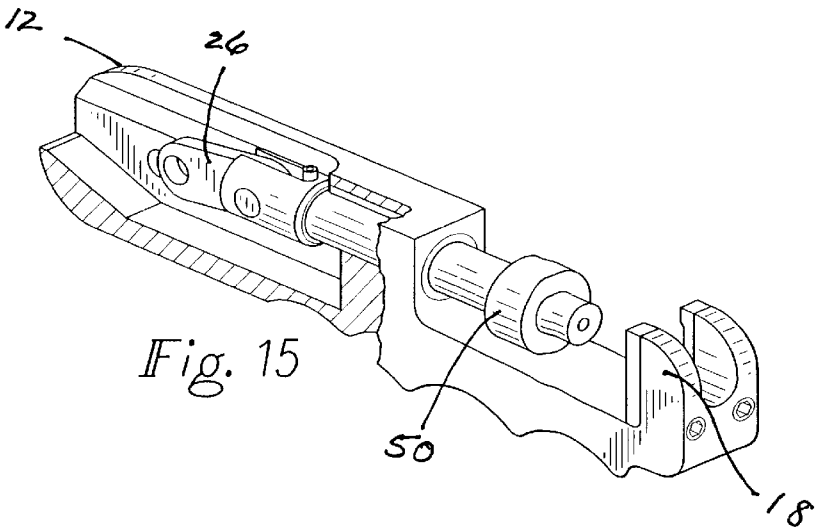
FIG. 15 is a view with parts broken away illustrating the movement of the linkage mechanism at the end of the crimping stroke.

Another modified form of biasing member is illustrated in FIG. 14 wherein a resilient sleeve 58 of a rubber or rubber-like material, such as, polyurethane is mounted under compression in the housing 50 to exert a biasing force against the end wall 52 of the housing as described with respect to the other forms of invention. Again, selection of a particular type of biasing member will depend on the load vs. deflection required for a specific application.

The die portion 18 serves to support a generally U-shaped seat 60 which is aligned with the open slot 20 and is provided with a concave seating surface 61 at the lower end of the slot 20 to receive the trailing end of the crimping ring 22 and center it with respect to the chuck 42.

The preferred and modified forms of crimping tool 10 are primarily intended for use with commercially available fittings or end connectors of the type having preinstalled crimping rings, namely, the fitting sold under the trademark DIGICON® by Antec Corporation of Denver, Colo. Another fitting of the same type is that sold under the trademark FCONN by ICM Corp, of Denver, Colo. FIG. 13 illustrates a fitting or connector N loosely assembled onto a coaxial cable C, and the cable C basically comprises an inner conductor 62, a dielectric insulator 64, an outer braided conductor 66 and a dielectric outer jacket 68. The cable end is prepared by removing a first length of the outer jacket 68 from the cable end and then removing a second length of the braided connector 66 and insulator 64 from the cable end to expose an end of the conductor 62, the second length being shorter than the first length. A portion 70 of the braided conductor 66 is folded back over a forward end of the outer jacket 68. The end of the cable C is inserted through the hollow interior of a crimping ring R into the end connector N, the crimping ring R being in the form of an annular body composed of a low-frictional material of limited compressibility having a rib at its leading end adapted to fit into one of the grooves $G_1$ and $G_2$ as hereinafter described and an outer reinforcing band B, preferably made from brass, and which closely fits over the external surface of the ring R. Conductor 62 and insulator 64 extend through the inner sleeve $S_1$ so that a forward end of the insulator 64 abuts the enlarged shoulder V while the end of the inner conductor 62 extends at least to the forward end of the fastener W. The braided conductor 66 and outer jacket 68 extend through the annular space A between the trailing ends of the sleeves $S_1$ and $S_2$, respectively, until the folded-over portion 70 abuts the rear end of the outer sleeve $S_2$. Once the cable is fully inserted through the crimping ring R and into the end connector N, the connector N, ring R and cable C are positioned as shown in FIG. 12 with the fastener W receiving the chuck 42.

The body 12 of the crimping tool is provided with grooves 13 along its undersurface to facilitate gripping in one hand when the palmar and thumb portion of the hand are folded over the lever arm 22. As shown in FIG. 14, by applying downward pressure to the lever arm 22, the linkage 26 will advance the plunger 30 toward the die member 18 until the end of the crimping ring R is firmly seated against the concave entrance 61. The generally concave configuration of the entrance 61 will serve to center the crimping ring R with respect to the chuck 42 and to act as an end stop as continuing axial force is applied via the chuck 42 to the connector N. The axial force applied by the chuck to the connector is sufficient to force the leading end of the ring R from a first groove $G_1$ and drive the ring R forwardly over the outer sleeve $S_2$ as the tapered surface T radially compresses the relatively thin-walled trailing end of the outer sleeve $S_2$ about the jacket 68 of the cable C such that the resilient material of the jacket 68 will fill the grooves between the endless rings M on the interior surface of the outer sleeve $S_2$. Continued axial force drives the ring R axially and forwardly until a forward end face of the ring R contacts the rear flange X of the fastener W and the leading end of the ring R seats within the second groove $G_2$. Once the leading end is secured within the groove $G_2$, the end connector N, ring R and crimped end of the cable C are removed from the chuck 42 and from the die 18.

An important consideration and feature of the crimping tool 10 is its ability to be self-compensating for different lengths of connectors N. Specifically, once the crimping ring R is forced from the groove $G_1$ toward the groove $G_2$, the biasing member 54, 56 or 58 as the case may be, will be gradually contracted or compressed by the retraction of housing 50 under the applied force of the lever arm acting through the plunger 30 until the lever arm 22 reaches its end limit of movement as shown in FIG. 14.

Figure 12:
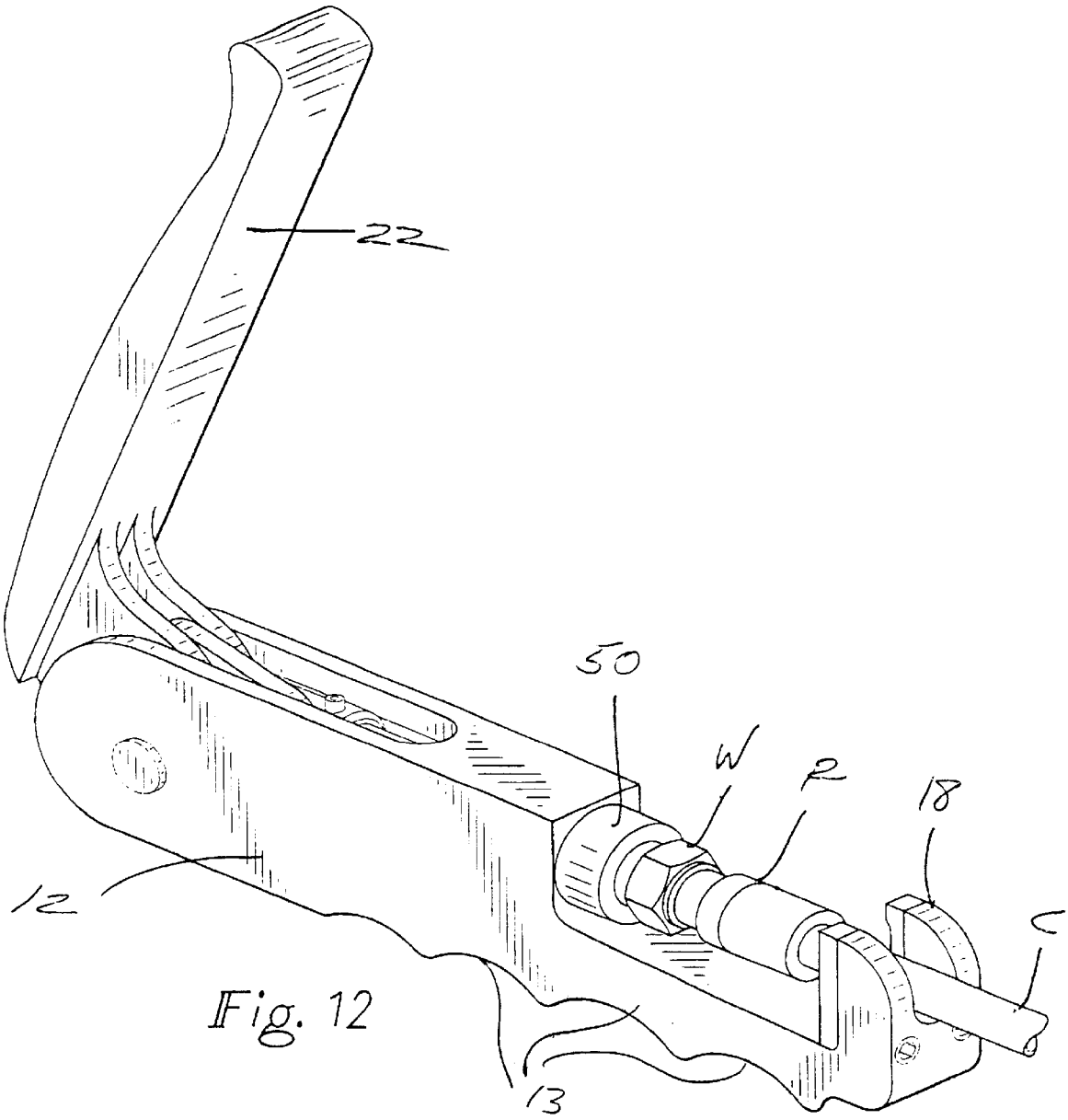
FIG. 12 is a somewhat fragmentary view in section illustrating the relationship between parts prior to the crimping operation.
Figure 13:
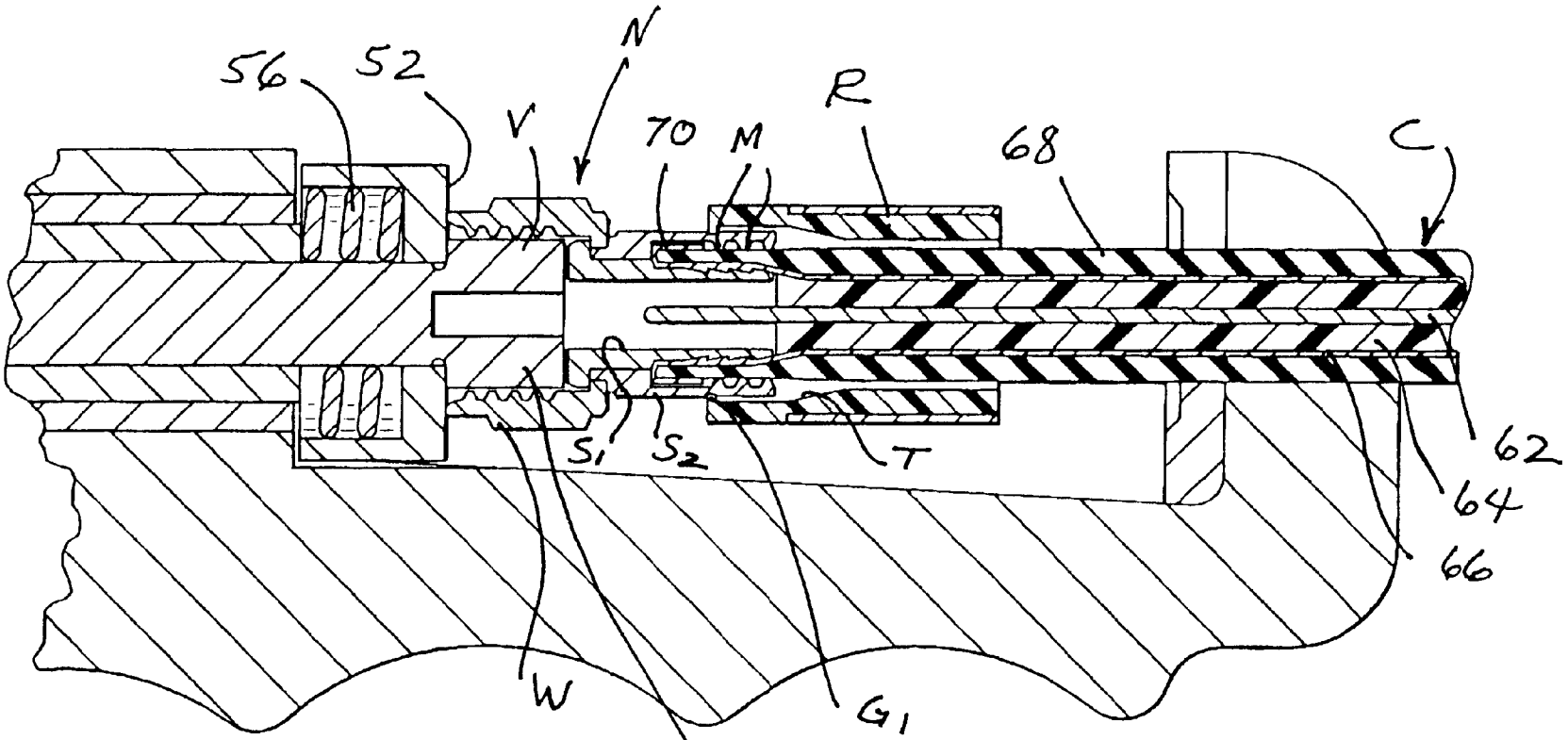
FIG. 13 is a perspective view similar to that of FIG. 1 but illustrating the lever arm in a raised position prior to the crimping operation.
Figure 16:
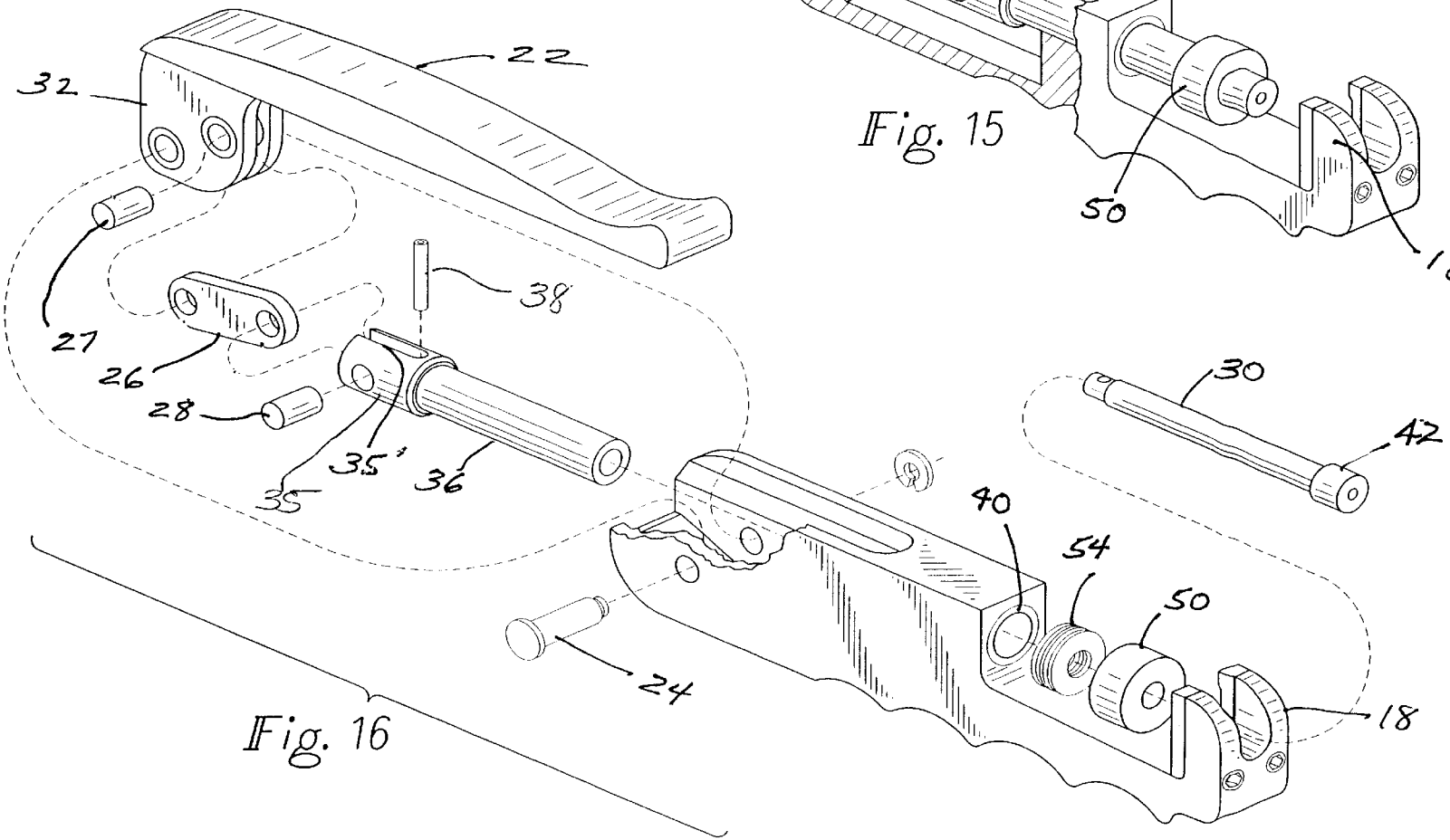
FIG. 16 is an exploded view of the preferred form of crimping tool in accordance with the present invention.

As the handle is grasped and manually pivoted through a full stroke from the open position shown in FIG. 12 to the closed position shown, for example, in FIG. 1 or FIG. 16, the crimping force resulting from axial movement of the crimping ring R increases for a given amount of applied force toward the end of the stroke; i.e., as the lever arm approaches the closed position. There are numerous contributing factors to this including the fact that the lever arm overlies the body and the applied force is increasingly in a direction transverse to the body as the lever arm approaches the closed position; also, the mechanical advantage of the lever arm is increased toward the end of the crimping stroke as a result of the offset connection of the floating link arm 26 with respect to the fixed pivot 24. The increased crimping force will assure optimum and complete crimping of the crimping ring R with respect to the connector end, specifically in such a way that the jacket 68 and folded over portion 70 of the cable C will be compressed into the serrations along the outer wall surface of the inner sleeve $S_1$ and the grooves M along the inner wall of the outer sleeve $S_2$. The load versus deflection value of the biasing member 54, 56 or 58 is selected such that once the crimping ring is axially advanced into the groove $G_2$ any continued applied force and lengthwise movement of the sleeve 36 is imparted to and absorbed by the spring or resilient element, as the case may be, as represented at 54, 56 or 58. For example, as illustrated in FIG. 9, as the lever arm 22 approaches its closed position, the sleeve 36 is free to advance independently of the plunger 30 and to further compress the spring 54 until the lever arm 22 reaches the end of its stroke.

Although preferred and modified forms of the invention have been herein set forth and described, it will be evident that the biasing member 50 is readily conformable for mounting in different types of crimping tools and different locations. For example, the biasing member consisting of the housing 52 and one of the spring elements 54, 56 or 58 may be of U-shaped configuration and mounted or incorporated as a part of the seat 60 in the die member 18. In a similar manner, one of the spring elements may be incorporated into the end stop which forms a part of the crimping tool of my hereinbefore referred to application for patent Ser. No. 150,154. Morever, the biasing means and chuck as hereinbefore described are conformable for use with a die member or tapered cavity of the type disclosed in my hereinbefore referred to U.S. Pat. No. 5,392,508 which is intended for use with a cable fitting of the type disclosed in my hereinbefore referred to U.S. Pat. No. 5,501,616, also incorporated by reference herein. In that type of fitting, a crimping ring is not required and the outer sleeve is crimped by direct engagement with the tapered cavity of the die member in response to axial advancement of the chuck toward the die member.

It is therefore to be understood that while preferred and modified forms of invention are herein set forth and described, the above and other modifications and changes may be made in the construction and arrangement of parts as well as their composition without departing from the spirit and scope of the present invention as defined by the appended claims and reasonable equivalents thereof.

I claim:

1. A hand-held crimping tool for connecting a sleeve portion of each of a plurality of cable fittings to an end of a respective coaxial cable wherein said tool is provided with a body having an end stop at one end of a cable-receiving channel, a plunger axially spaced from said end stop for supporting said sleeve in facing relation to said end stop with said cable end extending through said channel and at least partially inserted into said sleeve, and support means mounting said plunger for axial movement toward and away from said end sop whereby to force a crimping ring on said sleeve axially under sufficient force to radially contract said sleeve into crimpirg engagement with said cable end, the improvement in said tool comprising:

force-applying means for axially advancing said plunger toward and away from said end stop; and a resilient biasing member mounted under compression between said plunger and said support means being operative in response to axial advancement of said plunger toward said end stop beyond a maximum distance required for contracting said sleeve into crimping engagement with said cable end for undergoing axial compression when engaged by each of said fittings whereby to compensate for differences in length of said fittings.

2. The tool according to claim 1 wherein said biasing member is a spring member mounted on said plunger.

3. The tool according to claim 1 wherein said biasing means is defined by a spring member.

4. The tool according to claim 3 wherein said spring member is mounted in a cup-shaped housing on said plunger.

5. The tool according to claim 4 wherein said spring member is comprised of a plurality of annular disks of limited resiliency stacked against one another and encircling said plunger.

6. The tool according to claim 1 wherein said force-applying means is defined by a handle pivoted at one end to an end of said body.

7. The tool according to claim 6 wherein said handle is pivotally connected to an end of said plunger opposite to said biasing means and is pivotal into overlying relation to said body.

8. The tool according to claim 7 wherein said handle is so mounted with respect to said plunger as to apply increasing force to said plunger at the end of its stroke.

9. The tool according to claim 8 wherein said handle is pivotal at one end of said body and is movable into overlying relation to said body in applying an axial force to said crimping ring.

10. The tool according to claim 9 wherein said tool includes an elongated body in which said plunger is slidable, said handle having a fixed pivot at one end pivotally connecting said handle to an end of said body, and a pivot link between said handle and said plunger.

11. A hand-held crimping tool for connecting a sleeve portion of each of a plurality of cable fittings to an end of a respective coaxial cable, said tool comprising a body having an end stop at one end of a cable-receiving channel, a chuck axially spaced from said end stop for supporting said sleeve in facing relation to said end stop with said cable end extending through said channel and at least partially inserted into said sleeve, a plunger mounting said chuck for axial movement toward said end stop whereby to force said sleeve axially into crimping engagement with said cable end, the improvement in said tool comprising:

a spring-loaded biasing member on said plunger adapted to yieldingly engaging each of said fittings in response to axial advancement of said plunger toward said end stop whereby to cause said sleeve to crimpingly engage said cable end; and force-applying means for axially advancing said plunger and said chuck toward said end stop.

12. The tool according to claim 11 wherein said biasing member is mounted on said plunger behind said chuck.

13. The tool according to claim 11 wherein said biasing member is defined by a spring member comprised of a series of disk springs.

14. The tool according to claim 13 wherein said springs are mounted in a cup-shaped housing on said plunger, said springs mounted under compression between said support means and an end of said chuck.

15. The tool according to claim 14 wherein said springs are comprised of a plurality of annular disks of limited resiliency encircling said plunger and stacked against one another and said force-applying means is defined by a lever arm pivoted at one end to an end of said body and is operative to apply a progressively increased crimping force to said chuck.

16. The tool according to claim 15 wherein said lever arm is pivotally connected to an end of said plunger opposite to said biasing member and is pivotal into overlying relation to said body.

17. The tool according to claim 16 wherein said lever arm is pivotal at one end of said body and is movable into overlying relation to said body in applying a progressively increasing crimping force to said chuck.

18. A hand-held crimping tool adapted for connecting a sleeve portion of each of a plurality of cable fittings to an end of a respective coaxial cable, said tool comprising a body having an end stop at one end of a cable-receiving channel, a chuck axially spaced from said end stop for supporting said sleeve portion in facing relation to said end stop with said cable end extending through said channel and at least partially inserted into said sleeve, a plunger mounting said chuck for axial movement toward and away from said end stop whereby to force a crimping ring on said sleeve axially under sufficient force to radially contract said sleeve into crimping engagement with said cable end, the improvement in said tool comprising:

an axially compressible, spring-loaded biasing member on said plunger being responsive to axial advancement of said plunger toward said end stop adapted to yieldingly engage each of said fittings; and a lever arm for axially advancing said plunger toward and away from said end stop.

19. The tool according to claim 18 wherein said biasing member includes a cup-shaped housing mounted on said plunger and a resilient member mounted under compression within said housing between an end wall of said housing and an end of said support means.

20. The tool according to claim 19 wherein said resilient member is defined by a series of stacked springs.

21. The tool according to claim 19 wherein said resilient member is defined by a compression spring.

22. The tool according to claim 19 wherein said resilient member is defined by an annular plug.

23. The tool according to claim 18 wherein said lever arm is pivotally connected to one end of said body, and a pivot link pivotally connecting said plunger to said body in offset relation to the pivotal connection of said lever arm to said body.

* * * * *